United States Patent [19]

Daum

[11] 4,032,153

[45] June 28, 1977

[54] BOARD GAME ASSEMBLY

[76] Inventor: Daniel E. Daum, 977 Columbia Ave., Atlanta, Ga. 30309

[22] Filed: July 6, 1976

[21] Appl. No.: 702,622

[52] U.S. Cl. ..... 273/134 AT; 273/134 B

[51] Int. Cl.[2] ..... A63F 3/00

[58] Field of Search ..... 273/134

[56] References Cited

UNITED STATES PATENTS

| | | | |
|---|---|---|---|
| 1,389,162 | 8/1921 | Reed | 273/134 AT UX |
| 3,807,739 | 4/1974 | Henley et al. | 273/134 AT X |

*Primary Examiner*—Delbert B. Lowe

*Attorney, Agent, or Firm*—Newton, Hopkins & Ormsby

[57] ABSTRACT

A board game assembly comprising a game board having a plurality of juxtaposed sections, selected ones designated thereon to represent individual states and forming a path for a player to follow about the board with a playing piece, other selected sections forming alternate paths. The amount of movement of each playing piece is determined by dice. An area is designated on each state section for receiving an erasable stroke by each player to indicate his degree of control of that section, each player provided with a counter for registering the number of strokes available to him during play of the game. Play money is provided each player to pay for either a degree of control of the particular section landed upon or to pay another player as reward for his control of that section. Certain other sections dictate the movement of his playing piece should a player land on those sections. The object of the game is for one player to obtain control of the sections, thereby forcing the other players out of money and their control of the states.

10 Claims, 8 Drawing Figures

BOARD GAME ASSEMBLY

BACKGROUND OF THE INVENTION

1. Field of the Invention

This invention relates to games of chance and, more particularly, to a board game assembly.

2. Background of the Invention

Many games have been developed in the past which included the chance-controlled manipulation of playing pieces along a predetermined path on a game board. Such games are governed by certain rules which affect a player's status in the game, depending upon the particular location of that player's playing piece on the game board. Such prior art games include Darrow U.S. Pat. No. 2,026,082; Straitwell, Jr. U.S. Pat. No. 3,759,520; and Malisow, U.S. Pat. No. 3,889,954.

Certain disadvantages in those games include the dominance of the chance element in controlling the decisions of the player's movements across the board, thereby losing the appeal of those games to persons who enjoy challenge, strategy, excitement and mounting pressure in their game.

SUMMARY OF THE INVENTION

The above disadvantages are overcome by the present invention which includes a board game assembly comprising a game board having thereon a plurality of designated state and other positions which define a path of play along the board, playing pieces for each individual player, dice to determine the number of positions a player may advance during his moment of play, a counter for each player to register the number of strokes available to him to apply to the state positions in order to gain control of those positions, writing utensils for each player to place his erasable stroke upon the state section he desires to eventually control, state cards for each player which enable that player to more easily gain control of a particular state should that player land on the state card position on the board and money for initally even distribution to each player so that he may purchase control of desired state positions on the board. The object of the game is to gain control of enough state positions to make it difficult for the other players to keep their money should they land on those controlled state positions, such money being readily available in cash by that player or through the sale of his control of his state positions, thereby forcing that player to lose control of those state sections.

The rules of the game are determined by the will of the late Mr. Hartley, with each player being an heir who would like to control all of Mr. Hartley's possessions, namely, popcorn stands, throughout the United States and who must match his skill against the other heirs who are striving for that same control. Each state and the District of Columbia are represented on the game board by an individual position or square which, collectively, define a path of travel for each player in his quest for ultimate control. Selected state sections have circles thereon; ownership of a certain number of those states with circles means that a player has gained control and can extract triple the amount of money normally obtained when another player lands on a controlled section. Interspersed among the state positions are a number of other labeled positions, such as "DETOUR", "GIFT", "FREE", "PENALTY", and "STATE CARD", which, if landed upon by a particular player, influence that player's path along the board or ability to gain control of a state position. "Option States" and "Paired States" are included.

Each state position includes the purchase price for a player for one stroke to be applied to that state, if so desired. Three strokes are necessary to gain control of that state; when another player lands on a controlled state, he has to pay to the player who controls that state the money designated for that state. If, however, a player gains control of the requisite number of state positions which have circles thereon, then he raises a control indicator on the game board to evidence such control. The player who has gained such control receives triple the normal amount of money if another player lands on his controlled states or his state card square.

The players, each one having been assigned a particular color, place their individual strokes on a clear, plastic area located on each state position by means of a respective colored writing utensil which places a mark which can be erased from the plastic area. Each player also is assigned a stroke counter which enables him to indicate the number of strokes left to be utilized by him during play.

An object of the present invention is to provide a new novel game of chance employing a game board.

Another object of the present invention is to provide a game by which the players become familiar with the names of all the states of the United states and their official post office abbreviations.

A further object of the present invention is to provide a new game which enhances the business skills of the players by having them continually determine whether to invest for short term or long term returns.

DESCRIPTION OF THE PREFERRED EMBODIMENT

The late Mr. Hartley had interests in everything from popcorn stands to oil fields and gold mines across the United States. Just before his final departure, he sold all of his investments for profit, except his popcorn stands, and decided that the sum of $100 million would be left to only one of his heirs. Being a sporting man, he decided to have his four relatives compete for the money by following stipulations which he put in his will. These stipulations are the rules of the game. (Not all of the relatives have to be present, only 2 or 3 may compete at one time).

Also being a shrewd businessman, he wanted his fortune to go to the relative who could control his money wisely and still get the best return for it. To do this, he alloted each potential heir a certain amount of money to use to gain control of his popcorn stands within the states. Since some of the locations have an immediate good return and some have long run potential, each heir must decide whether to try for control of the states on the board which are landed on more often, or to try to gain control of enough of certain designated states to give him triple return on all of his controlled areas.

Figure 3:
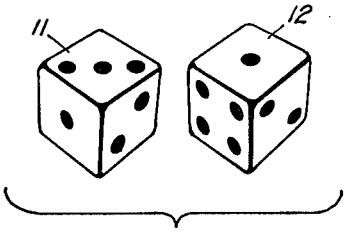
FIG. 3 is a perspective view of the pair of dice of the present invention.
Figure 4:
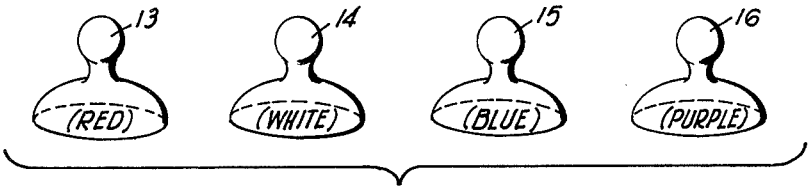
FIG. 4 is a perspective view of the playing pieces of the present invention.
Figure 6:
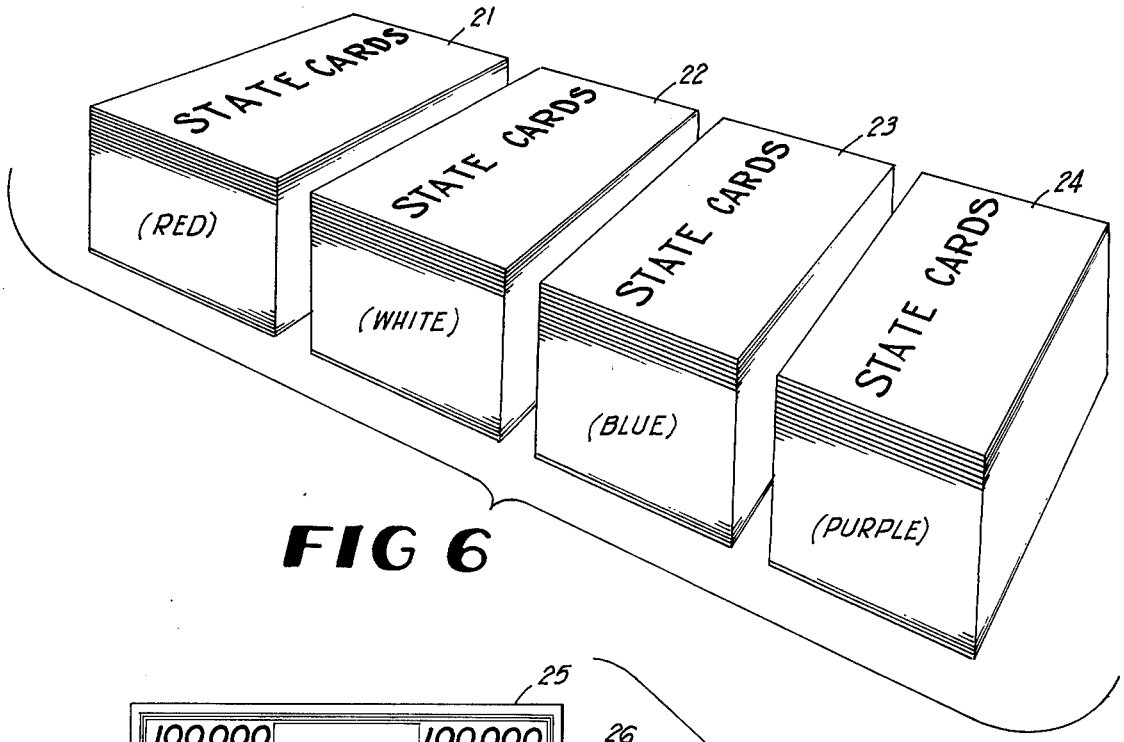
FIG. 6 is a perspective view of the stacks of state cards of the present invention.
Figure 7:
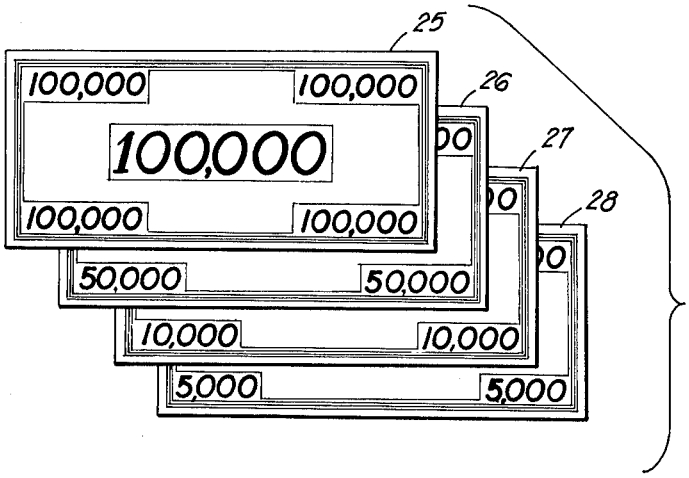
FIG. 7 is a perspective view of the different denominations of play money of the present invention.
Figure 8:
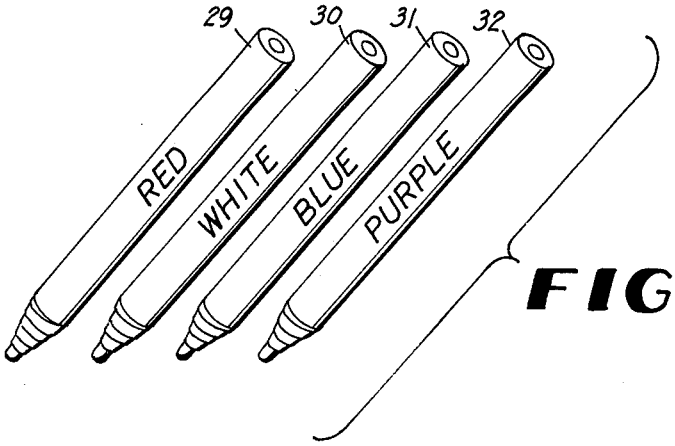
FIG. 8 is a perspective view of the marking pencils of the present invention.

The object of this game is to become Mr. Hartley's heir and win the $100 million check. This is done by running your competitors out of money and gain control of all of Mr. Hartley's popcorn stands within the states, while, at the same time, controlling your own money so that you don't have to go over $500,000.00 to do it. Referring to the figures of drawing, the present invention when four persons are players, is comprised of a game board 10 (FIG. 1); a pair of dice 11, 12 (FIG. 3); four playing pieces 13, 14, 15, 16 (FIG. 4); four different colored stroke counters 17, 18, 19, 20 (FIG. 5); four different colored stacks of state cards 21, 22, 23, 24 (FIG. 6); four different denominations of play money, namely, a $100,000 bill (25); a $50,000 bill (26); a $10,000 bill (27); and a $5,000 bill (28), as shown in FIG. 7; and four different colored marking pencils 29, 30, 31, 32 (FIG. 8).

Figure 1:
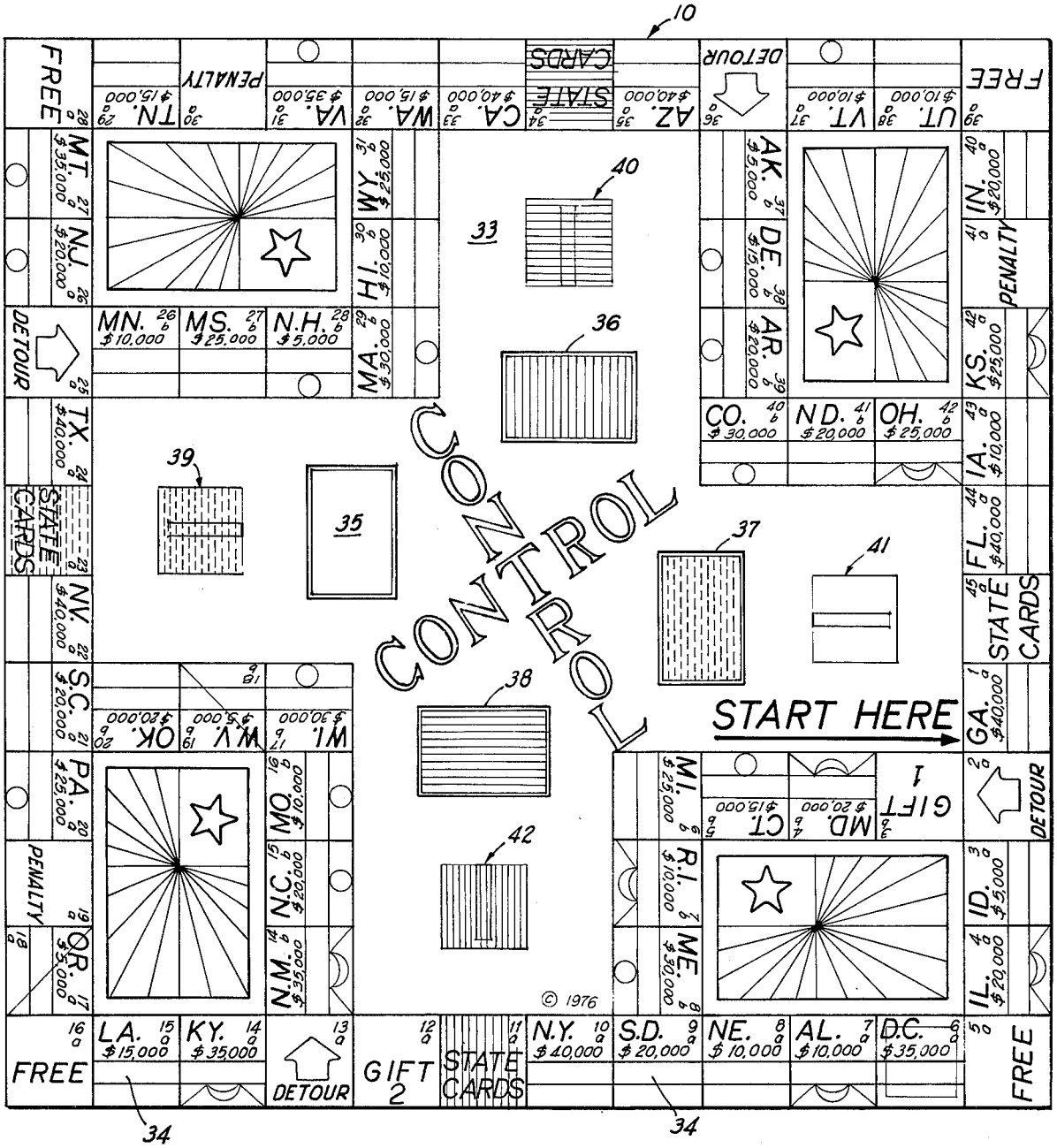
FIG. 1 is a top plan view of the game board of the present invention.

Referring now to FIG. 1, the board 10 includes a flat rectangular playing surface 33 having designated thereon a primary playing path about the board 10 comprising a plurality of rectangular sections 1–45*a* disposed about the periphery of board 10. Sections 3*b*–8*b*, 14*b*–20*b*, 26*b*–31*b* and 37*b*–42*b* are also designated on surface 33 and represent alternate playing paths, as will be described in detail hereinbelow.

Some of the sections on board 10 are state sections and include 1*a*, 3*a*, 4*a*, 6*a*–10*a*, 14*a*, 15*a*, 17*a*, 18*a*, 20*a*–22*a*, 24*a*, 26*a*, 27*a*, 29*a*, 31*a*, 32*a*, 33*a*, 35*a*, 37*a*, 38*a*, 40*a*, 42*a*–44*a* which form a primary path of play about the periphery of board 10; and Sections 4*b*–8*b*, 14*b*–20*b*, 26*b*–31*b* and 37*b*–42*b* which are interconnected to the primary path to form alternate playing paths. There are fifty-one state sections including one (6*a*) for the District of Columbia which is shown with a double-line border. Each of the state sections has printed thereon the official Post Office abbreviation for the particular state.

Some of the state sections have circles thereon. and include Connecticut (5*b*), Maine (8*b*), North Carolina (15*b*), Missouri (16*b*), Wisconsin (17*b*), Pennsylvania (20*a*), New Hampshire (28*b*), Massachusetts (29*b*), New Jersey (26*a*), Montana (27*a*), Virginia (31*a*), Delaware (38*b*), Arkansas (39*b*), Colorado (40*b*) and Vermont (37*a*). The paired states are those having a half-moon design thereon and include Maryland (4*b*) and Illinois (4*a*), Rhode Island (7*b*), Alabama (7*a*), New Mexico (14*b*), Kentucky (14*a*), Ohio (42*b*) and Kansas (42*a*). Two of the state sections, Oregon (17*a* and 18*a*) and West Virginia (18*b* and 19*b*) are diagonally divided in half and are OPTION STATES.

Transversely disposed across the middle of each state section is a rectangular-shaped clear plastic area 34 which serves as a means for receiving an erasable mark or stroke placed thereon by a player.

Centrally positioned on surface 33 are four rectangular state card sections 35, 36, 37, 38, each being of a different color to receive thereon the respective colored stacks of state cards 21, 22, 23, 24.

Figure 2:
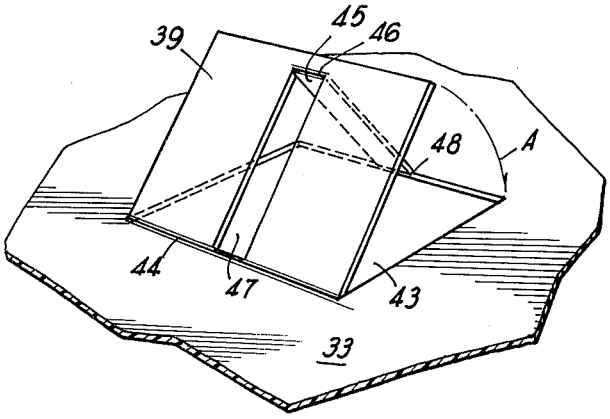
FIG. 2 is a partial perspective view of the board of FIG. 1 showing a control indicator.

Adjacent each section 35, 36, 37, 38 is a colored control indicator 39, 40, 41, 42, a representative one of which is shown in detail in its elevated or operative position in FIG. 2. Each indicator 39, 40, 41, 42 is rectangular in shape. There is provided in the board 10 an opening 43 of sufficient dimensions to receive therein the indicator 39, in its inoperative position or co-planar alignment with surface 33. The indicator 39 is pivotally mounted on the board 10 along one edge 44 of opening 43. A small rectangular section 45 is cut out of indicator 39 except along top end 46, thereby forming opening 47 to allow section 45 to pivot and support at its lower end 48 indicator 39 on surface 33 in the operative position as shown in FIG. 2. To place the indicator 39 in its inoperative position, the section 45 is manually removed from engagement with surface 33 and moved into the opening 47 and into alignment with the surface of indicator 39. The indicator 39 is then pushed downwardly about end 44 along the direction of arrow A until it is in co-planar alignment with surface 33, as shown in FIG. 1.

The pair of dice 11, 12 are conventional, each having 6 faces or sides with from one to six dots appearing on each face. Any conventional chance-controlled indicator can be utilized, such as a spinning arrow on a card marked with the appropriate number of spaces that can be moved at one time.

The playing pieces 13, 14, 15, 16 can be of any suitable design, as long as they have a surface which can engage and remain stationary on surface 33 in the absence of being manipulated by a player.

Figure 5:
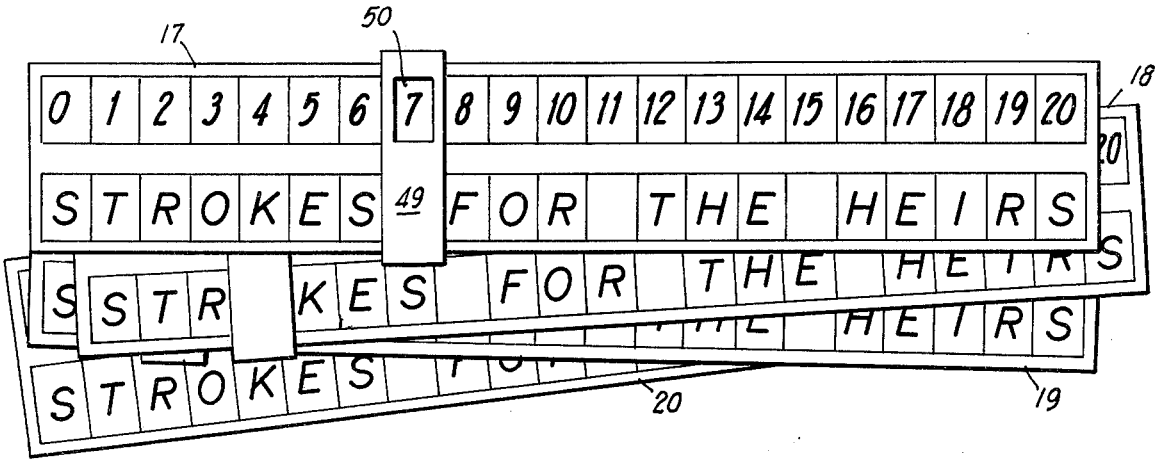
FIG. 5 is a perspective view of the stroke counters of the present invention.

For registering the number of marks or strokes available to a player, stroke counters 17, 18, 19, 20 are provided which are rectangular in shape, having individual areas 0 to 20 enumerated along their top end. A viewer 49 is slidably disposed for transverse movement across the counters 17, 18, 19, 20 and includes an opening 50 therethrough of dimensions similar to those of an individual enumerated area 0–20. The counters 17, 18, 19, 20 indicate to each player the remaining strokes that respective player has available in the game. Thus, as illustrated in FIG. 5, the player having counter 17 would know that seven strokes are still left to be used.

Each of the stacks of state cards 21, 22, 23, 24 contain 52 cards having individually written on them one of fifty states and the District of Columbia, plus one card labeled "EXCEPTION". The stacks 21, 22, 23, 24 are placed on the board 10 on their respective colored state card sections 35, 36, 37, 38. Each card is marked in the top right hand corner with the number which corresponds with the number of its matching state or the District of Columbia on the board 10. The OPTION STATES cards have two numbers each: Oregon, 17*a* and 18*a*, and West Virginia, 18*b* and 19*b*, as shown on the board 10. The EXCEPTION card is not numbered, because it does not have a corresponding square on the board.

In playing the game with four players, each one receives at the beginning of the play three $100,000 bills (25), three $50,000 bills (26), three $10,000 bills (27) and four $5,000 bills (28), for a total of $500,000.

Each player receives a respective colored pencil 29, 30, 31, 32 which are utilized to mark the respective player's strokes on areas 34 on each state section on the board 10. The marks or strokes made by each pencil 29, 30, 31, 32 on the areas 34 can be erased if those strokes have to be removed under the rules of the game.

Each potential heir or player chooses a playing piece 13, 14, 15, 16 to represent him on the game board 10 and places the respective playing piece at the starting point of the game, namely on the "GA" state section which is marked by the numeral 1*a*. The stacks of state cards 21, 22, 23, 24 are placed on their respective state card sections 35, 36, 37, 38 on the board 10. One of the players is selected to serve as the banker.

Each player has a "STROKES FOR THE HEIRS" counter 17, 18, 19, 20 which matches the color of his playing piece 13, 14, 15, 16 and stack of state cards 21, 22, 23, 24. The numbers 0–20 appearing on the counters 17, 18, 19, 20 represent the amount of strokes which each player has available at the beginning of the game to place on the state sections. The strokes are placed on area 34 on each state section by the respective players marking pencil 29, 30, 31, 32. When placed on the board, the strokes represent the amount of control of Mr. Hartley's popcorn stands a potential heir or player has within a particular state.

Depending on the number of players in the game, each participant places three strokes on the number of states specified below:

| 2 PLAYER GAME | 3 PLAYER GAME | 4 PLAYER GAME |
|---|---|---|
| 4 states with circles | 3 states with circles | 2 states with circles |
| 3 other states | 3 other states | 3 other states |
| (includes paired states) | (includes paired states) | (includes paired states) |
| Need 8 with circles for | Need 6 with circles for | Need 4 with circles for |
| triple money control | triple money control | triple money control |

If there is a dispute among the players concerning the choice of states, the dice 11, 12 are thrown to determine the sequence of choice. The player with the highest roll chooses first, the player with the second highest roll chooses second, etc.

As the players begin to drop out of the game, the number of states with circles needed to maintain control for triple money increases in accordance with the number of players left in the game.

In the beginning of the game, the player doesn't subtract the strokes applied to the states as described above from his stroke counter 17, 18, 19, 20. When a player has control of a certain number of the states with circles thereon, he receives triple the amount of money he ordinarily receives when someone lands on his controlled state or state card square (as described hereinbelow). When a player achieves this type of control, he raises his respective control indicator 39, 40, 41, 42 to its operative position. For example, in a game with four players, each player must have 4 states with circles for control and triple money return.

The dice 11, 12 are rolled to determine the sequence of players, with the player having the highest roll being first, etc. The starting point on board 10 is Section 1*a* (Georgia) with play proceeding sequentially along the sections.

A player may move the primary playing path or the alternate playing path unless specifically directed along an alternate path by landing on a DETOUR square.

The amount of money needed to gain control of all the popcorn stands within each state was precomputed by Mr. Hartley before his death. He also determined the cash amount of fines which had to be paid when stopping on someone else's controlled areas.

Each participant proceeds with his turn by moving clockwise around the board and following procedures described in the stipulation of the will below.

Stipulations of Mr. Hartley's will:

1. If a potential heir receives enough money to give him more than $500,000 in cash on hand, he must return all but $200,000 to the bank.

2. When a participant places a stroke on the board, he adjusts his slide viewer 49 on his counter 17, 18, 19, 20 to show the stroke used. A player may buy strokes to add to his counter 17, 18, 19, 20 only before taking his turn. When he adds strokes, he moves the slide viewer 49 to show the amount he then has available to use. He can have only 20 strokes available to use on his counter 17, 18, 19, 20 at any one time. If he goes over this amount, he loses the extra strokes without a refund. Strokes cost $5,000 each.

3. A player receives one extra throw of dice 11, 12 when he throws doubles. If he throws doubles twice, he moves the number of spaces minus three that is shown on the dice 11, 12. A player may not move more than twice in one turn.

It is possible to go backwards because of going back three spaces when doubles are thrown twice in a row. As an example, if the second roll of the dice is "snake eyes" or two, then the number of spaces to be moved would be $(+2)+(-3)=-1$ or one backward move.

4. When a player lands on a state section, he may place one stroke on it by paying to the bank the price marked under the state name. He places this stroke on the blank space 34 on the state section. He may only place one stroke at a time. To have control of all of the popcorn stands within the state, he must place 3 of his strokes on the state before the other heirs can. (Placing 3 would not apply to shorter version games).

5. When a potential heir becomes the controller in a state, he erases the other participants' strokes if there are any on the square. The losing participants add these back to their respective counters 17, 18, 19, 20, but they do not get a refund of the amount of money paid for those recaptured strokes.

6. A player who can not pay his debts from his cash on hand may sell his strokes back to the bank. He may sell strokes from his counter 17, 18, 19, 20 or remove them from the board 10. In either case, he receives only $5,000 per stroke. If he removes a stroke from a state he controls, he loses control of that state. Paying a debt is the only time a player may sell his strokes for cash.

7. When a participant sells his strokes from the board 10 to the bank to pay a debt to another player, the other player may replace the removed strokes with his own strokes from those available on his counter 17, 18, 19, 20. He does not have to pay the price marked under that state name. He still collects the money owed him by the debtor. (Example: The red player owes the purple player $40,000 and he does not have any money, or strokes available on his counter 17, 18, 19, 20. The red player must remove 8 of his strokes from the board 10 and cash them in to the bank for $40,000. The purple player replaces the strokes which were removed with 8 of his own strokes and also receives the $40,000 which the red player now has. The debtor chooses which strokes to remove from the board 10 when paying a debt.

8. Anytime a participant is payed, whether from another player, the cards, or the bank, he can take a combination of strokes and money, all strokes, or all money. If he takes strokes, they become a part of his strokes available for use on his counter 17, 18, 19, 20, although a player may have no more than 20 available strokes for use on his counter 17, 18, 19, 20 at any one time.

9. There are only two times when a competitor may remove a stroke from one of the states with circles:

1. When the potential heir who controls only states with circles owes a debt and he has neither cash nor strokes available to use on his counter 17, 18, 19, 20 to cover the debt.

2. When the only states a player has control of are states with circles and another player has the opportunity to remove one of his strokes from the board 10.

10. PAIRED STATES: These are states marked on the board by colored, half-moon designs. They are paired because of their money value being equal. When a participant lands on one of the paired states, he pays the controller the price marked under the name of the state he has landed on. (Unless triple money is indicated by indicators 39, 40, 41, 42). As indicated above, a player may elect one or more of the paired state groups in the beginning of the game. When buying strokes for these pairs, you may buy one stroke on the state landed on and place one free stroke on the other state in the pair. When placing a free stroke on the other state in the pair, that stroke is not counted as being used on the stroke counter 17, 18, 19, 20. When removing a stroke from one of the states in the pair and getting a refund for it, a player also has to remove one stroke from the other state in the pair without a refund. The stroke removed without a refund is not added back to the stroke counter 17, 18, 19, 20. If a player is replacing lost strokes on these paired states, he places one stroke for each one the losing player takes off for a refund and one free stroke on the other state in the pair. His first stroke is subtracted from his counter 17, 18, 19, 20 as used, but the free one is not. When a participant gains control of one of the states in the pair, he automatically controls the other state in the pair.

11. OPTION STATES: When landing on a state section which has been diagonally divided in half, that player has the option to pay $50,000 to the bank and place 2 strokes anywhere on the board which is not already controlled, or to pass up that opportunity and continue play as usual. These state squares count as 2 spaces.

Special Space Procedures

In his will, Mr. Hartley also described certain benefits and penalties which could be incurred during the course of the competition. These occurrences are designated on the board 10 by special spaces. The procedures to follow are as described below:

STATE CARD SQUARES

When a potential heir lands on a square labeled "STATE CARDS" (11*a*, 23*a*, 34*a* or 45*a*) which matches his playing color, he collects a bonus of $10,000. If he lands on a state card square which matches another player's color, he must pay that participant a $5,000 fine. If no player is using the color landed on, he must pay the bank a $5,000 fine. He does this before turning over the matching state card in the respective stacks 21, 22, 23, 24. If a player does not have a stroke available for use on his counter 17, 18, 19, 20, he does not turn over the respective matching card.

All but one of the cards in each stack 21, 22, 23, 24 have a different state or the District of Columbia written on them. If the state written on the card is not controlled, a competitor may place a stroke on its corresponding state on the board 10 without paying the price marked on the square. He uses a stroke from one of the strokes available on his respective counter 17, 18, 19, 20. If he does not have a stroke for use on his counter 17, 18, 19, 20, he does not get to place one on the state. If the state is controlled by another participant, he must pay that player his normal rate or triple, if so indicated by indicators 39, 40, 41, 42. If he controls the state, he may remove one stroke from each of the other competitors' states. The losing players do not get a refund and do not add the strokes back to their counters 17, 18, 19, 20. However, the participant with the state card cannot remove a stroke from any circle state unless those circle states are the only states on which the losing player has a stroke. The participant who lands on the square chooses which of his competitor's strokes to remove.

If a player turns over the one EXCEPTION card in each stack 21, 22, 23, 24, he must remove three of his own strokes from the board 10. He chooses which ones to remove, but they do not go back to his strokes available for use on his counter 17, 18, 19, 20 and he does not get a refund.

When landing on a state card square, a player does not move his playing piece to the state indicated on the card.

FREE SQUARES

When a participant lands on any of the four spaces 5*a*, 16*a*, 28*a*, 39*a* marked FREE situated at each corner of the board 10, he may place one stroke from his counter 17, 18, 19, 20 on any state that is not controlled. (If he does not have a stroke available for use on his counter 17, 18, 19, 20, he does not place one.) He does not have to pay the price stipulated for a stroke for that particular state section. If all of the states are controlled, he may remove one of his competitor's strokes from the board 10 in order to place his free one. A player landing on a free space always gets to place a free stroke as long as he has a stroke available for use on his counter 17, 18, 19, or 20. If a stroke is removed in order to place a free one, the losing player does not add this stroke back to his counter 17, 18, 19, 20 and does not get a monetary refund.

PENALTY SQUARES

When landing on a square marked "PENALTY", a player must lose one turn. If he threw doubles, he does not throw again. During his lost turn, he does not collect from the other players who land on his state card sections or controlled states. A player may wish to land on the PENALTY square in order to avoid, at least for his turn, a payment to another player that he may have to make if he should land on that player's controlled square.

DETOUR SQUARES

As explained above, a competitor landing directly on a square marked DETOUR, those being 2a, 13a, 25a, 36a, he must move in the direction of the arrow when he throws again. Thus, the DETOUR sections force a player along an alternate playing path.

GIFT SQUARES

GIFT 1 (3b): If a potential heir lands on this square, the bank will match his amount of cash on hand.

GIFT 2 (12a): The reward for landing on this square is the same as for landing on GIFT 1, except a player must pass by way of the D.C. square in order to collect.

The gift squares pay according to what a player has in cash on hand at the time he lands on those squares. Sometimes, a player would want to avoid those square because landing on them would put him over the $500,000 limit for cash on hand and, therefore, he would lose money.

OPTION STATES

A player has the option of placing two strokes anywhere on the board 10 by paying $50,000 to the bank, but only if there is space available to place those strokes. This option differs from landing on a FREE square whereby a player always gets to place a stroke on a state square even if it means that an opponent's stroke is removed from the board 10.

CIRCLE STATES

Strategy comes in when deciding when and if to try for control of the states with circles to gain triple money or other states which pay off sooner because they are landed on more often. Because these circle states do not pay off very well by themselves, if a player concentrated too much on controlling them in the beginning of the game, he might be forced out of money before he could gain triple control. However, if he concentrated too much on the other types of states, someone else may gain triple control and force him out of the game. Thus, the circle states may be of a disadvantage to control at certain times in the game and advantageous at other times.

Players must strive to obtain control of enough states with a high monetary payoff or good position on the board to keep enough money to meet their demand, while at the same time getting control of enough circle states to gain triple control and receive triple money on all their controlled areas. The state cards also can work for you and against you. At the beginning of play, all are good, but as the game goes on, this can change.

For shorter games, the players may decide to use either one or two strokes for control of the states. When using one for control, you must place two strokes on the states with circles in order to control them. When using two strokes to control the other states, use three for control of the states with circles.

However, as you decrease the number of strokes needed for control, the amount of strategy involved in the game decreases proportionately. Therefore, players may determine the amount of such strategy they prefer in their games. Of course, the more strategy involved in a game, the longer will be the game. Strategy increases with the number of strokes used for control and also with the number of players.

The following is an example of how strategy becomes such an important factor in applicant's game: If 4 people are playing, using 3 strokes for control, each of the players may have already placed 1 or 2 strokes on the same state square. Then when 1 of the players gets the opportunity to place a free stroke or take the option offered by landing on the OPTION STATES, he must decide what would be to his advantage and also to the others disadvantage. He might go ahead and take control of that state for the purpose of making the other players lose money or keeping them from controlling a state which would be a good advantage to them. On the other hand, if he needed control of a different type of state (such as a high payoff state or a circle state for triple control), he might go ahead and place his stroke(s) there to try for control of it. Because of decisions like this, there is a constant battle for control within each state square.

The OPTION STATES are important because they aid the players in gaining cntrol of the states faster thereby making the game move faster. They also add to the strategy because a player must determine if he is financially able to spend the money required and how much benefit he will receive from placing his strokes. EXAMPLE: New Hampshire only costs $5,000 per stroke normally and it could be the last place open on the board. However, if the player spent the $50,000 to put 2 strokes on it and that gave him control of enough circle states for triple control, it would be to his advantage to do so. But if the only state not controlled was Alaska, he would have to expect the state to pay off from him 10 times in order to get the money back. On the other hand, if the state were Arizona which cost $40,000 per stroke, placing 2 for $50,000 would be advantageous.

Although but one specific embodiment of this invention is herein shown and described, it is intended as illustrative in a generic sense and not for purposes of limitation and it will be understood that variations of the apparatus and the game board shown may be made without departing from the spirit of the invention being set forth in the following claims.

What is claimed is:

1. A board game assembly for at least two players, comprising:

a. a board having thereon a plurality of juxtaposed sections forming a primary path of play about said board, other of said sections selectively interconnecting said primary path to form alternate playing paths, selected ones of said sections of said primary and alternate paths having means for receiving thereon a removable mark to signify the degree of control of said section by a player;

means for identifying the position of a player along said paths;

c. means for marking on said receiving means;

d. means for registering the number of marks available to a player;

e. artificial money for a player for purchase of said selected sections of compensation to another player as a consequence of placing the identifying means of that other player on one of said selected sections; and f. chance-controlled means for determining the number of said sections a player may advance his identifying means along said paths during one sequence of play;

g. said selected sections having thereon means for determining the amount of money necessary for obtaining control of said selected sections; and h. wherein certain of said selected sections have means thereon to indicate that a player controlling a preselected number of said selected sections receives extra compensation when the identifying means of another player is on one of said selected sections.

2. A board game assembly as claimed in claim 1 including a set of cards for each player, each of said sets comprising separate cards for each selected section and means on said paths for directing each player to utilize a card from his set in order to obtain control of one of said selected sections.

3. A board game assembly as claimed in claim 2 wherein said board includes means for indicating control of a required number of said selected sections, said control indicating means comprising a segment of said board capable of pivotal movement about one of the ends of said segment between an elevated operative position above said board and an inoperative position in co-planar alignment with said board.

4. A board game assembly as claimed in claim 3 wherein sections are provided along said primary path for directing the movement of said identifying means involuntarily along said alternate paths when said identifying means is on one of said sections.

5. A board game assembly as claimed in claim 4 wherein certain of said sections are designated to involuntarily determine the further movement of said identifying means along said paths when said identifying means is on one of said designated sections.

6. A board game assembly as claimed in claim 5 wherein said board includes sections whereby a player whose identifying means is on one of said sections automatically receives an amount of money equal to the amount of money in the possession of said player prior to being on said section.

7. A board game assembly as claimed in claim 6 wherein said board includes sections whereby a player whose identifying means is on one of said sections may arbitrarily place one of said marks on another one of said selected sections that is not controlled by another player.

8. A board game assembly as claimed in claim 7 wherein certain of said selected sections have means thereon to indicate a pairing thereof whereby a player whose identifying means is on one of said certain of said selected sections may place a mark on the receiving means on said certain section in payment of the required amount of said artificial money and may place a mark on the receiving means of the paired section.

9. A board game assembly as claimed in claim 8 wherein said board includes sections whereby a player whose identifying means is on one of said sections does not participate in the subsequent sequence of play.

10. A board game assembly as claimed in claim 9 wherein said board includes sections whereby a player whose identifying means is on one of said sections has the option of placing at least two marks on said selected sections upon the payment of a preselected amount of money and if said selected sections are not controlled by another player.

* * * * *